US005575721A

United States Patent [19]

Lilly

[11] Patent Number: 5,575,721

[45] Date of Patent: Nov. 19, 1996

[54] GOLF GRIP SLEEVE DEVICE

[76] Inventor: Joseph T. Lilly, 7403 Garland Ave., Takoma Park, Md. 20912

[21] Appl. No.: 546,239

[22] Filed: Oct. 20, 1995

[51] Int. Cl.[6] ..... A63B 57/00

[52] U.S. Cl. ..... 473/282; 473/299; 473/300; 150/160; 2/17

[58] Field of Search ..... 473/282, 298, 473/299, 300; 150/160; 2/17

[56] References Cited

U.S. PATENT DOCUMENTS

| | | | |
|---|---|---|---|
| 3,203,005 | 8/1965 | Burrows | 2/17 X |
| 3,397,891 | 8/1968 | Koch | 473/298 |
| 4,200,133 | 4/1980 | Whitlow | 150/52 |
| 4,662,415 | 5/1987 | Proutt | 150/52 |
| 4,979,548 | 12/1990 | Howard, III et al. | 150/159 |
| 5,076,581 | 12/1991 | Boberg | 473/282 |
| 5,133,395 | 7/1992 | Moore | 150/160 |
| 5,203,390 | 4/1993 | Eckstein | 150/160 |

*Primary Examiner*—George J. Marlo
*Attorney, Agent, or Firm*—Henderson & Sturm

[57] ABSTRACT

A golf grip sleeve device (10) for keeping a golfer's hands and the handle grip (101) of a golf club (100) dry in wet condition; wherein, the device (10) includes an elongated open ended waterproof sleeve member (11) having a side opening (15) formed therein; such that the handle grip (101) may be inserted into one open end (12) of the sleeve member (11), one hand of the golfer may be inserted through the other end (13) of the sleeve member (11), and the other hand of the golfer may be inserted through the side opening (15).

11 Claims, 1 Drawing Sheet

GOLF GRIP SLEEVE DEVICE

TECHNICAL FIELD

The present invention relates to the field of golf accessories in general, and in particular to a device that can be used by a golfer to keep the handle grip of a golf club dry when the golfer is using the club in the rain.

BACKGROUND ART

As can be seen by reference to the following U.S. Pat. Nos. 5,203,390; 4,662,415; 5,133,395; and 4,979,548; the prior art is replete with myriad and diverse devices for keeping both individual and multiple golf clubs dry in inclement weather.

While all of the aforementioned prior art constructions are more than adequate for the basic purpose and function for which they have been specifically designed, these patented structures are uniformly deficient with regard to allowing the golfer to directly contact the grip surface while the grip is being covered by a protective device.

In addition, none of the prior art constructions make provisions for also keeping the golfers glove and hands dry while using these patented arrangements; nor do they provide means for protecting the grip portions of a plurality of golf clubs from early morning dew conditions, or after placing the clubs back in the bag to do other things such as drive the golf cart, etc. without removing the glove.

As a consequence of the foregoing situation, there has existed a longstanding need for a new type of grip protection device that will cover both the grip portion of a golf club and golfers glove and hands while in use; and, which can also be employed to protect a number of golf club handle grips: which a golfer is going to choose from upon reaching the ball on a clear day, when the golfer has to put the remaining clubs down on the ground while the golfer is using a selected golf club. The provision of such a construction is a stated objective of the present invention.

DISCLOSURE OF THE INVENTION

Briefly stated, the golf grip sleeve device that forms the basis of the present invention comprises in general, an elongated generally cylindrical sleeve member having a tapered lower end dimensioned to receive the upper shaft and handle grips of a golf club; and, an enlarged upper end dimensioned to receive both of the golfers hands.

In addition the sleeve member is further provided with an angled slot which is dimensioned to receive the golfers ungloved hand.

As will be explained in greater detail further on in the specification, in one version of the preferred embodiment the enlarged upper end of the sleeve member is optionally provided with an elasticized collar that will expand to accept the golfer's gloved hand and allow the upper portion of the sleeve member to fit either inside or outside of the sleeve of the golfer's outer layer; such that, when the sleeve member is positioned exterior to the outerwear it forms an effective barrier to prevent rain from running down the glove arm of the golfer.

In another version of the preferred embodiment, the enlarged upper end of the sleeve member is provided with a hook and loop fastening arrangement to provide a snug fit with the golfer's glove arm and/or outerwear.

In addition, the angled slot in the sleeve member is further provided with a rain diverting means so that water will not enter the sleeve member during use.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
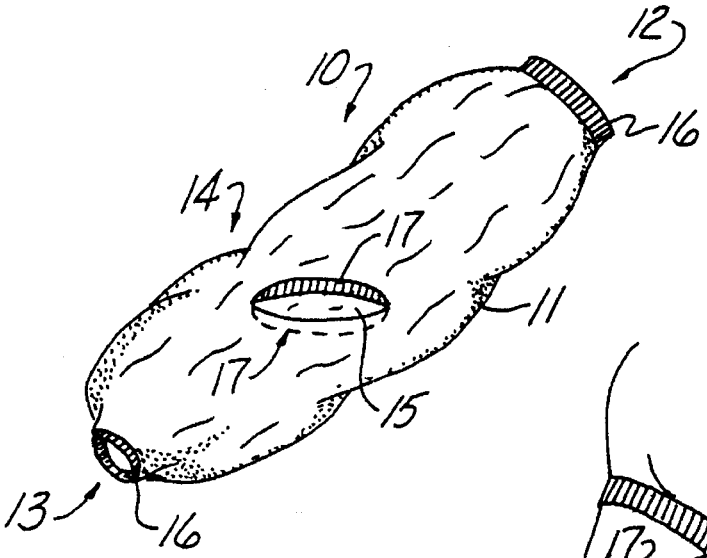
FIG. 1 is a perspective view of the golf grip sleeve device that forms the basis of the present invention; and, FIG. 2 shows a golfer addressing the ball with the device in place; and, FIG. 3 is a rear view arrangement depicted in FIG. 2.

As can be seen by reference to the drawings, and in particular to FIG. 1, the golf grip sleeve device that forms the basis of the present invention is designated generally by the reference numeral (10).

The device (10) comprises in general an elongated waterproof sleeve member (11) having an open upper end (12) an open lower end (13) and an intermediate portion (14).

In addition, the intermediate portion (14) of the sleeve member (11) is provided with an opening (15) which is angled relative to the longitudinal axis of the sleeve member (11), and dimensioned to receive the back or power hand of a golfer.

Figure 2:
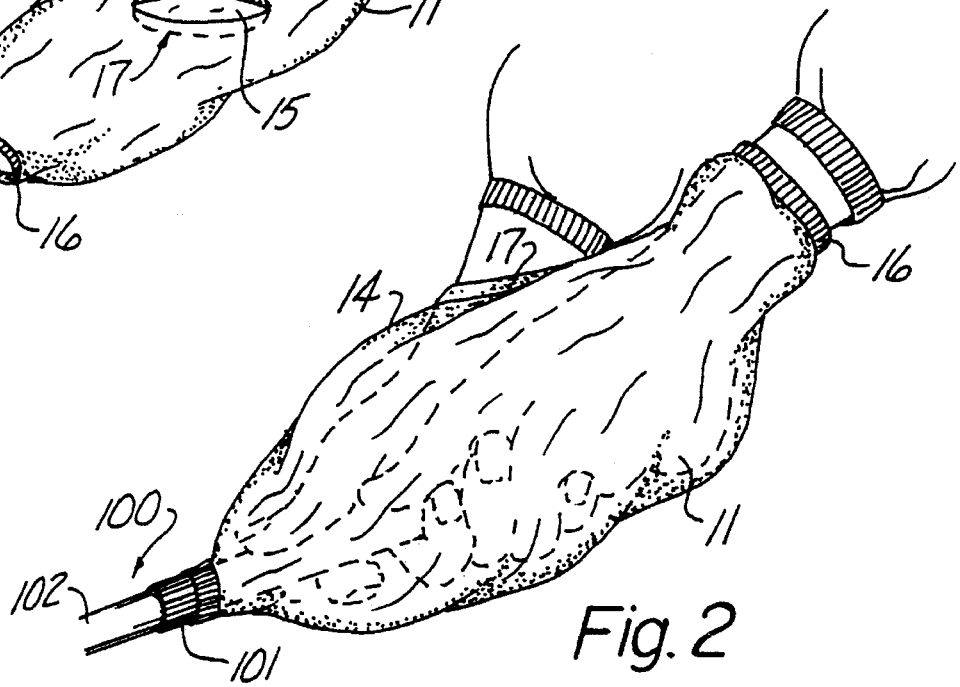
Figure 3:
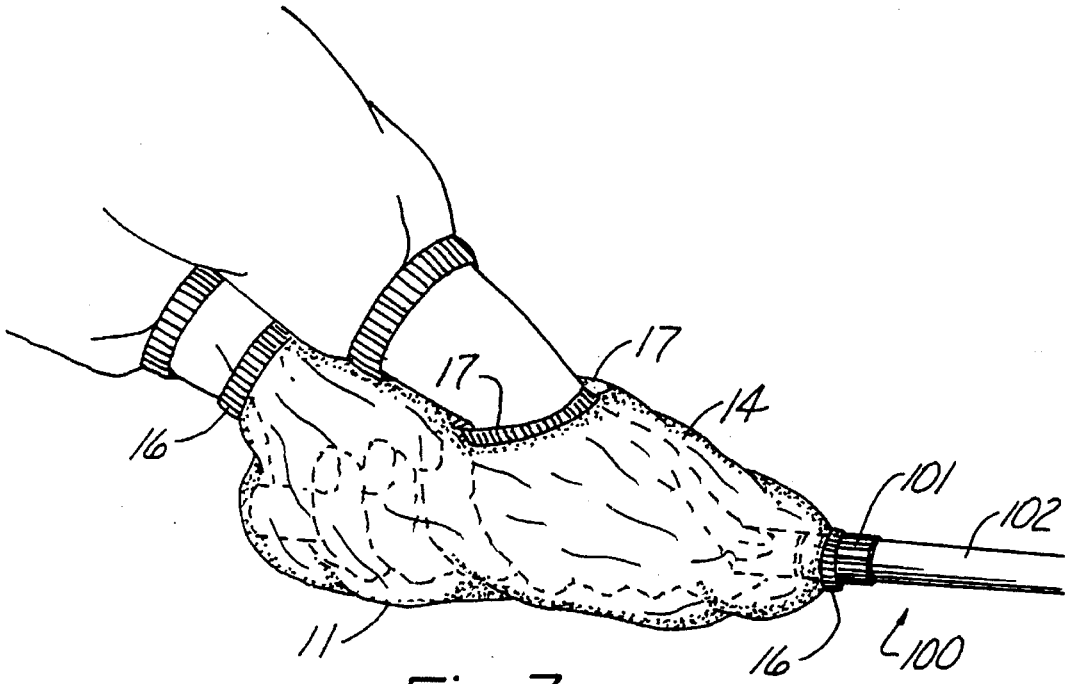

As can best be appreciated by reference to FIGS. 2 and 3, the lower end (13) of the sleeve member (11) is dimensioned to receive the handle grip (101) of a golf club (100); the upper end (12) of the sleeve member (11) is dimensioned to receive the power or glove hand of a golfer; and the intermediate portion (14) is dimensioned to receive both of the golfers hands when they are in direct contact with the handle grip (101) of the golf club (100).

In the preferred embodiment of the invention illustrated in FIGS. 1 and 2, the lower end (13) of the sleeve member (11) has a generally tapered configuration which will loosely surround the shaft (102) of the golf club (100) while in use.

In addition, the upper end (12) of the sleeve member (11) is provided with an elasticized cuff element (16) which will snugly encircle the forearm of the golfer to prevent rain from running down the golfers arm. As was mentioned previously the cuff element (16) can be worn either inside or outside of the sleeve of the golfers outerwear; however, for the best results the cuff element (16) should be placed in direct contact with the golfers lower arm, so that water will be deposited on the outside of the sleeve member (11) as opposed to relying upon the cuff element (16) to prevent passage of water between the cuff element (16) and the sleeve of the golfer's outerwear.

As can also be seen by reference to FIGS. 1 through 3, in the preferred embodiment of the invention, the opening (15) in the intermediate portion (14) of the sleeve member (11) may be provided with either an elasticized collar element or at least one contoured flap (17) to prevent water from entering through the opening(15).

As shown in FIG. 3, the contoured flap (17) is disposed proximate to, and dimensioned to overlie, a portion of the opening (15); such that when the golfer's guiding or ungloved hand is inserted through the opening (15) water will be diverted around the opening (15) in a well recognized fashion.

While the collar arrangement depicted in FIG. 2 can be utilized by either a right or left handed golfer, the flap arrangement in FIG. 3 is suitable for a left handed golfer; and, in order for the flap arrangement to be interchangeable between right and left handed golfers an additional flap (17) depicted in phantom must be added.

At this juncture it should be apparent that the golf grip sleeve device (10) as described herein provides significant advantages over the prior art constructions for the following reasons. First of all the golfer can put the device on prior to beginning play which will keep his or her golf glove dry throughout the round. In addition this device (10) will keep the golf club handle grip dry as well as both hands, beginning from the time that the golfer removes the club from the golf bag, walks to the ball, makes the golf shot and then returns the club to the bag. This device (10) also allows the golfer to place the device over the handles of a number of golf clubs when the grass is wet, and the golfer is unsure of which club to use to make the shot. Once the club selection has been made and the desired club removed from the device (10), the remaining clubs can be laid on the wet grass with no adverse affects due to the protection afforded to the handle grips sheathed within the device.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A golf grip sleeve device for keeping a golfers hands and the handle grip of a golf club dry in wet conditions; wherein, the device comprises:

an elongated open ended sleeve member having a lower end dimensioned to receive the handle and shaft of a golf club, an intermediate portion dimensioned to receive both of the hands of a golfer and an upper end dimensioned to receive one of the hands of a golfer; and, an opening formed in the intermediate portion of the sleeve member; wherein, said opening is dimensioned to receive the other of the hands of the golfer.

2. The device as in claim 1; wherein, the upper end of the sleeve member is further provided with means for snugly encircling a portion of the golfer's lower arm associated with said one hand.

3. The device as in claim 2; wherein, said means for snugly encircling a portion of the golfer's lower arm associated with said one hand comprises an elasticized cuff element.

4. The device as in claim 2; wherein, said means for snugly encircling a portion of the golfer's lower arm associated with said one hand comprises cooperating hook and loop fastening elements.

5. The device as in claim 1; wherein, said opening is provided with means for preventing the entry of water through said opening.

6. The device as in claim 5; wherein, the opening on the intermediate portion of the sleeve member is disposed at an angular orientation relative to the longitudinal axis of the sleeve member.

7. The device as in claim 5; wherein, said means for preventing water from entering through said opening comprises a collar element surrounding said opening.

8. The device as in claim 7; wherein, said collar element is elasticized.

9. The device as in claim 5; wherein, said means for preventing water from entering through said opening comprises at least one flap element disposed proximate to said opening.

10. The device as in claim 9; wherein, said flap element is dimensioned to overlie at least a portion of said opening.

11. The device as in claim 1; wherein, both the upper and lower ends are provided with means for allowing the openings in the upper and lower ends to be expanded.

* * * * *